US005299862A

United States Patent [19]

Rankine

[11] Patent Number: 5,299,862

[45] Date of Patent: Apr. 5, 1994

[54] STORAGE DEVICES

[76] Inventor: Gordon Rankine, Sherwood, 578 Queens Ferry Road, Edinburgh, Scotland

[21] Appl. No.: 650,774

[22] Filed: Feb. 5, 1991

[30] Foreign Application Priority Data

Feb. 6, 1990 [GB] United Kingdom ..... 9002605

[51] Int. Cl.[5] ..... E05G 1/026

[52] U.S. Cl. ..... 312/329; 109/26; 109/27; 109/49.5; 109/84

[58] Field of Search ..... 292/DIG. 88, DIG. 41; 70/267-270; 194/217, 900; 312/329, 319, 214, 313, 409; 109/26, 27, 80, 82-84, 49.5, 24, 26

[56] References Cited

U.S. PATENT DOCUMENTS

| | | | |
|---|---|---|---|
| 816,724 | 4/1906 | Hall | 109/84 |
| 1,120,435 | 12/1914 | Benham | 109/27 |
| 1,186,964 | 6/1916 | Armstrong | 312/213 X |
| 1,525,203 | 2/1925 | Schmitz | 312/409 X |
| 1,949,133 | 2/1934 | Smith | 49/379 |
| 1,964,578 | 6/1934 | Hunter | 312/214 X |
| 4,178,859 | 12/1979 | Seiz et al. . | |
| 4,304,070 | 12/1981 | Musacchia | 49/379 X |
| 4,773,020 | 9/1988 | Anderson et al. | 194/900 X |
| 4,957,196 | 9/1990 | Shiojima et al. | 70/DIG. 41 |

FOREIGN PATENT DOCUMENTS

| | | |
|---|---|---|
| 0006403 | 1/1980 | European Pat. Off. . |
| 0065605 | 12/1982 | European Pat. Off. . |
| 0334726 | 9/1989 | European Pat. Off. . |
| 2152022 | 7/1985 | United Kingdom . |
| 2154256 | 9/1985 | United Kingdom . |
| 2171733 | 9/1986 | United Kingdom . |

*Primary Examiner*—Peter R. Brown

*Attorney, Agent, or Firm*—Mason, Fenwick & Lawrence

[57] ABSTRACT

This structure relates to storage devices and in particular to lockers in particular for luggage such as those to be found at airports and railway stations. The lockers of the present device comprise a door, preferably with no moving parts, which, when the locker is not in use, is permanently biased open and thus in an unlocked position. When the locker is in use the door can be secured merely by shutting the door of the locker. A number of lockers of the present invention can be incorporated into columns of lockers under the control of a central control unit which dispenses appropriate receipts and tickets in exchange for money.

11 Claims, 6 Drawing Sheets

STORAGE DEVICES

BACKGROUND OF THE INVENTION

1. Field of the Invention

The present invention relates to storage devices and in particular to left luggage lockers for use in, for example, railway stations, airports and shopping centres.

2. Related Art

Traditional luggage lockers have typically comprised a number of individual lockers, perhaps of varying sizes to accommodate different sizes and shapes of luggage, each locker typically having a separate lock, handle and coin operated mechanism.

Insertion of a coin, or coins into the coin operated mechanism allows a customer to open the locker, place their luggage inside, lock the locker and remove the key. These traditional lockers are labour intensive to maintain because, for example, there are a lot of separate coin mechanisms to empty.

Recent developments of this traditional system have focused on the possibilities of having an automatic central control point, where all the money for the operation of the lockers is collected, which controls the operation of a number of lockers and where the traditional keys are replaced with magnetic cards which when inserted in a locker act as keys. These magnetic cards are also dispensed form this central control point.

Examples of such systems are disclosed in the following European Patents and Patent Applications.

European Patent No. 6403 describes a system whereby a central control unit controls the operation of a large number of lockers. The locker to be used by a particular customer is selected by the central control unit, and not by the customer himself, and thus, if the lockers are of different sizes, or stacked up in columns, it takes no account of the size of luggage to be placed in the locker selected by the central control unit nor does it take account of the customer's ability to place the luggage in the locker, particularly if the locker selected by the central control unit is placed at the top of a column of a number of lockers.

European Patent No. 65,605 describes a locker system having one control unit for each column of lockers, each control unit having hexadecimal coding wheels to identify each locker in the column. This system is both expensive, since a large number of control units are required if more than one column of lockers is used, which will be commonly the case particularly in busy airports, for example. In addition the mechanical coding wheels will tend to be less reliable than electronic systems.

A European Patent Application No. 334 726 also describes a locker system having a central control unit. In this case the customer has to enter a personal secret code number, which he composes, into the central control unit when depositing his luggage. This personal secret code number must then be re-entered to gain access to the luggage. This has obvious disadvantages in that the customers, if the fails to remember his personal secret code numbers will be unable to gain access to his luggage.

One further feature of previously known locker systems is that the individual lockers all have handles on them to allow them to be opened and are generally kept shut to even when empty. These can be awkward to use particularly if the customer has luggage in both hands which he wishes to place in the selected locker. The customer is thus forced to place his luggage down to operate the handle and open the locker selected.

SUMMARY OF THE INVENTION

It is an object of the present invention to overcome or mitigate some or all of the disadvantages associated with the known storage devices.

According to the present invention there is provided a storage system comprising at least on storage container having allowable access means and a central control unit characterized in that said lockable access means is biased in an open position when the storage container is in an unlocked mode.

Further, according to the present invention, there is provided a storage system which has a lockable access means in the form of a door, the lockable access means having a front wall and a means to protect the front wall form the effects of an explosion within the storage container. Preferably, the protection means is a rear wall of the door, spaced apart form the front wall of the door, the arrangement provided to absorb shock form any explosion within the container.

DETAILED DESCRIPTION OF THE PREFERRED EMBODIMENTS

Figure 1:
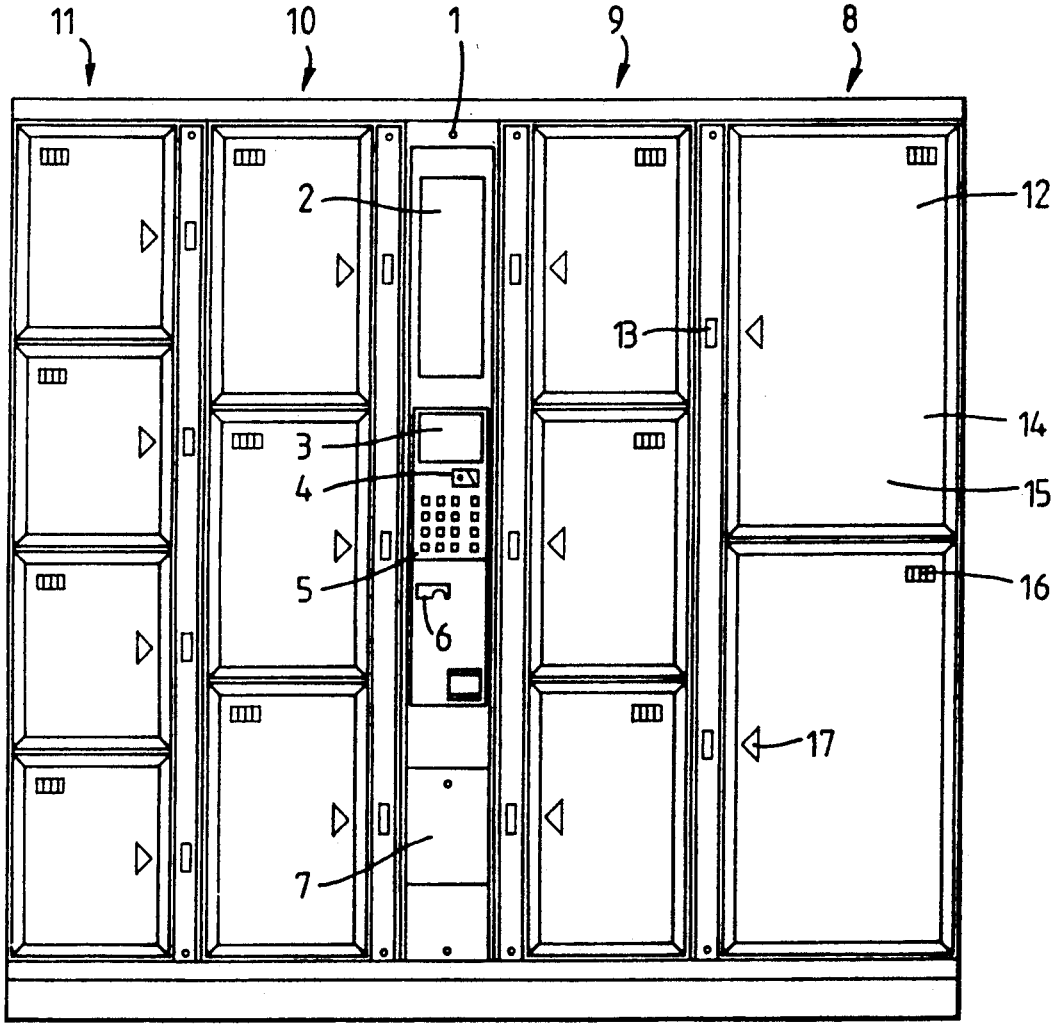
FIG. 1 is a front elevation view of a preferred embodiment of the present invention.

By storage container is meant any container which can be used to store securely an article. Suitable storage containers include for example luggage lockers, changing lockers, clothes lockers, safe deposit boxes, lockers for skis.

When the storage container is in the form of a locker for skis (in which case it would be very long), for example, then the inside of the storage container can include, for example, a number of additional optional features such as heaters, to dry the boots and skis, and rods or hooks or similar objects on which to hang ski boots. It will be appreciated that these additional internal features may be included in storage containers of the present invention to the than those intended for use for storing skis.

In a preferred embodiment the lockable access means comprises for example a hinged door. When the storage container is unlocked this is biased in an open position. This biasing can be done by any conventional means including for example springs incorporated into the hinges. Preferably the lockable access means, in the form of a door, for example, has no moving parts.

The lockable access means is preferably automatically locked by merely pushing it into a closed position whereupon, for example, electronically controlled bolts housed in the main body of the storage container will engage with part of the lockable access means to lock the storage container. It will be appreciated that any conventional means for automatically locking the storage container can be used.

Suitably the electronically controlled bolts will be inserted into the body of the lockable access means, there being preferably at least one bolt which will insert itself into a side of the lockable access means and more preferably there will be a number of bolts both at the sides, at the top and at the bottom which insert into both the side, the top and the bottom of the lockable access means. Suitably these bolts will be made from stainless steel and penetrating at least 10 mm into the body of the lockable access means.

Preferably the lockable access means will have no external handle. One benefit of this system is that the customer can firstly readily identify all empty lockers, because the doors will be ajar, place the article e.g. luggage in easily and then lock the storage container merely by pushing the door too when it is automatically locked. Equally when the storage container is unlocked form the central control unit then the lockable access means is then automatically moved into an open position by the biasing means.

In a further preferred embodiment the inner face of the lockable access means will also have a flush face. In a further preferred embodiment of the is invention the lockable access means, having both an inner and an outer flush face, will be manufactured of a hollow construction so that the gap between the inner and outer faces can be filled with air or other materials including, for example, foam etc which can be employed to increase the resistance of the lockable access means to vandalism or for resisting or containing any explosion which might occur in the storage container as a result of, for example, an act of terrorism. Suitable materials for the infill between the outer and inner faces of the locate access means are well known to those skilled in the art and will not be described further herein. Suitably the choice of material can be selected such that the inner face of the lockable access means can be sdesigned to collapse progressively into the infill before the blast from any explosion reaches the front face of the lockable access means thereby minimising the effects of he blast and reducing the risk of any part of the storage container or lockable access means being blown out and forming a projectile.

By ensuring that both faces of the lockable access means are flush and by ensuring that the locking mechanism is contained within the main body of the storage container it will be apparent that in the event of any explosion in the storage container the risk of any projectile being blown out from the lockable access means is significantly reduced in comparison with lockable access means having for example locks or handles incorporated therein which could form projectiles in the event of an explosion in the storage container.

In addition the main body of the storage container can be so constructed so as to minimize the effect of any blast in the storage container. Such measures could include, for example, a thin-walled rear panel, perhaps having louvres in it, which would be intended to rupture first in the event of any explosion. Equally the side and top and bottom walls of the storage container could also be double skinned, as can the lockable access means, and the infill between the double skin being filled with either air or some other suitable material again to reduce the effects of any explosion.

The multiplicity of bolts entering into the leakable access means will reduce the risk of the whole body of the lockable access means being blown out in the event of nay explosion inside the storage container.

The storage system of the present invention has a number of other optional features which can be incorporated into preferred embodiments of the present invention.

These additional features, in no particular order are as follows.

Preferably there is incorporated into a storage container of the present invention a display panel or indicator beside the lockable access means which indicates whether the storage container is empty or occupied. This can be done by any known means including for example red and green flashes or lights, red preferably signifying occupancy and green preferably signifying vacancy. Textual messages can also be sued to indicate whether the storage container is empty or occupied. Preferably the display panel is controlled and activated by a central control unit.

The central control unit of the present invention can incorporate a number of preferred features including a microprocessor computer along with a screen and a keyboard. The screen and keyboard are used for interactive dialog with the container regarding the operation of each storage container.

In a preferred embodiment the computer and its associated software can be programmed to display all instructins on the screen, and conduct a dialog with the customer, in any one of the languages including for example French, English and German, which are programmed into the central control unit. In practice then number of languages employed can be about 64 or even more. A particular language can be selected by the customer, for example, by using a dedicated key on the keyboard. In addition the computer programmes and other requirement employed in the control unit can also deal with a number of different, i.e. national, coin sets. These features allow a control unit to be customized locally so that the appropriate combinations of languages and coin acceptance can be employed.

The central control unit of the present invention can control a large number, typically up to at least 32, of storage containers. This mean that the cost of a storage system of the present invention is much reduced, particularly when compared with known storage systems with one control unit per column of lockers, since the greatest part of the cost of a storage system is due to the control unit.

The central control unit of the present invention will also preferably incorporate a coin collector or cash box, a escrow unit and a means, such as a printer, for example, for producing a voucher.

In a further embodiment the central control unit can e connected to a communications system including, for example, a telephone system or a radio system so that remote interrogation and operation of the central control unit can be effected.

In yet a further embodiment the central control unit can incorporate an audio system so as to issue instructions with regard to the use of the storage containers to those who are visually impaired.

In a preferred embodiment the voucher is in the form of a coded ticket which contains among other information a unique identifier. This unique identifier can be in any known form including, for example, a unique number, a bar code, magnetic code or a machine readable code. The unique identifier is used by the customer to later unlock his storage container. In the case of a unique number of this has to be entered, via the keyboard, by the customer to open his storage container. In the case of the other unique identifiers described above they can be read by appropriate known equipment incorporated into the central control unit. The said voucher can either be two layered thus obviating the need of a printer ribbon or it can be single layered for use with a printer ribbon.

The unique identifier is created by any known means including, for example, by using an algorithm. This algorithm can be used to create unique identifier codes which allow a control unit to recognize that the code is correct but for another control unit. Thus if a user enters a code correctly at a control unit, but at the wrong control unit, the control unit advises the customer as to which control unit is the correct one.

Known alarm systems and indicators, either manual or electronic, can be incorporated into the storage systems of the present invention to indicate respectively whether unauthorized entry into a storage container is occurring or whether an individual storage container is empty or not.

The computer in the central control unit can be used to process and collate data such as monies collected, occupancy rates of individual storage containers for use by the owner of the storage system.

Preferably the storage system of the present invention, with the possible exception of the screen, will operate form a low voltage electricity source to minimize the risk of accidental electrocution of the Customer. Preferably the low voltage will come form a battery in the storage system which is charged from the mains via a transformer.

One important benefit of the present invention is that because the cable access means are easily operated then high columns of the storage containers of the present system can be used, the height of the column being dependent only on the scale of average human accessibility.

Figure 2:
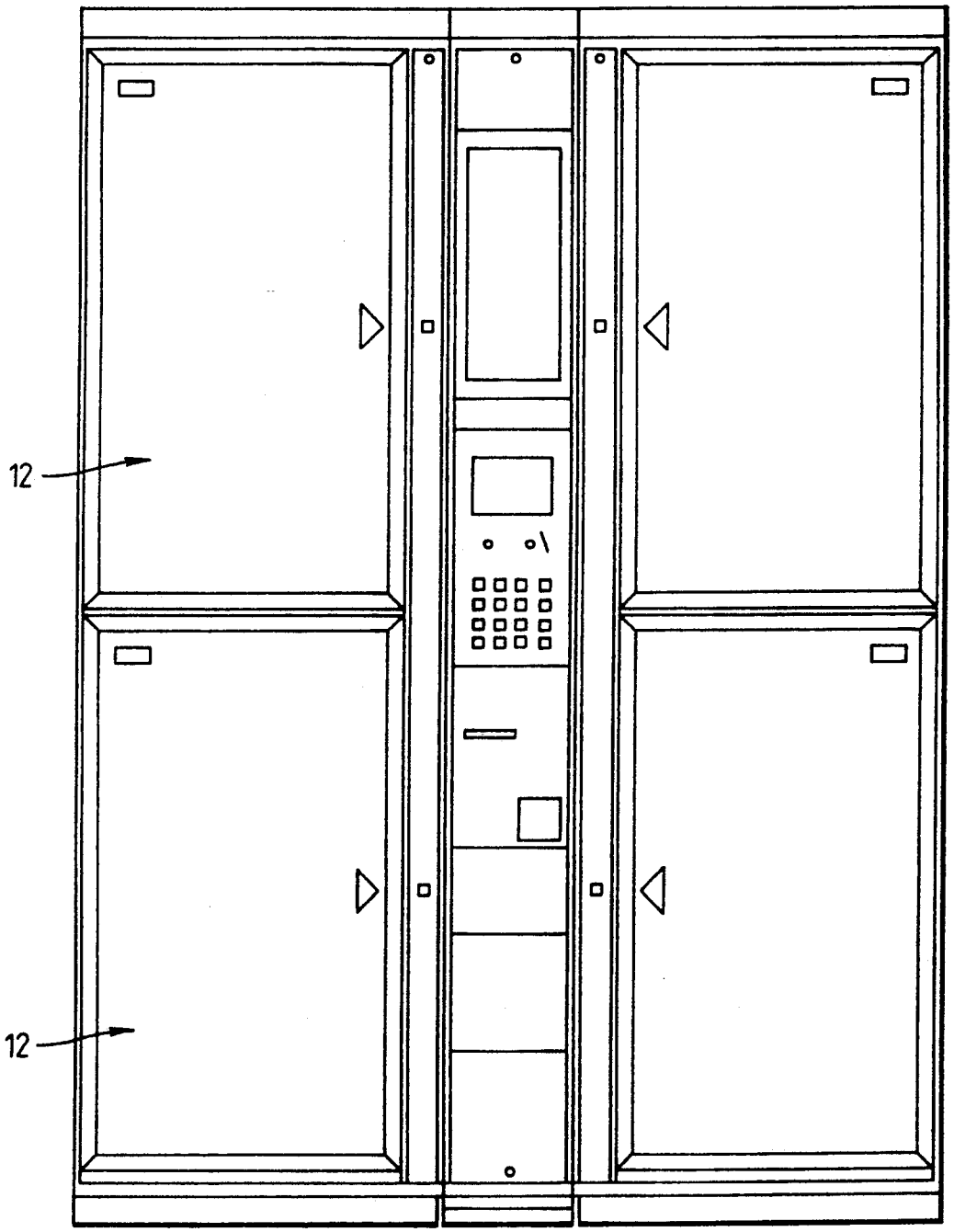
FIG. 2 is a front elevation view of an alternative arrangement of the storage system of the present invention.
Figure 3:
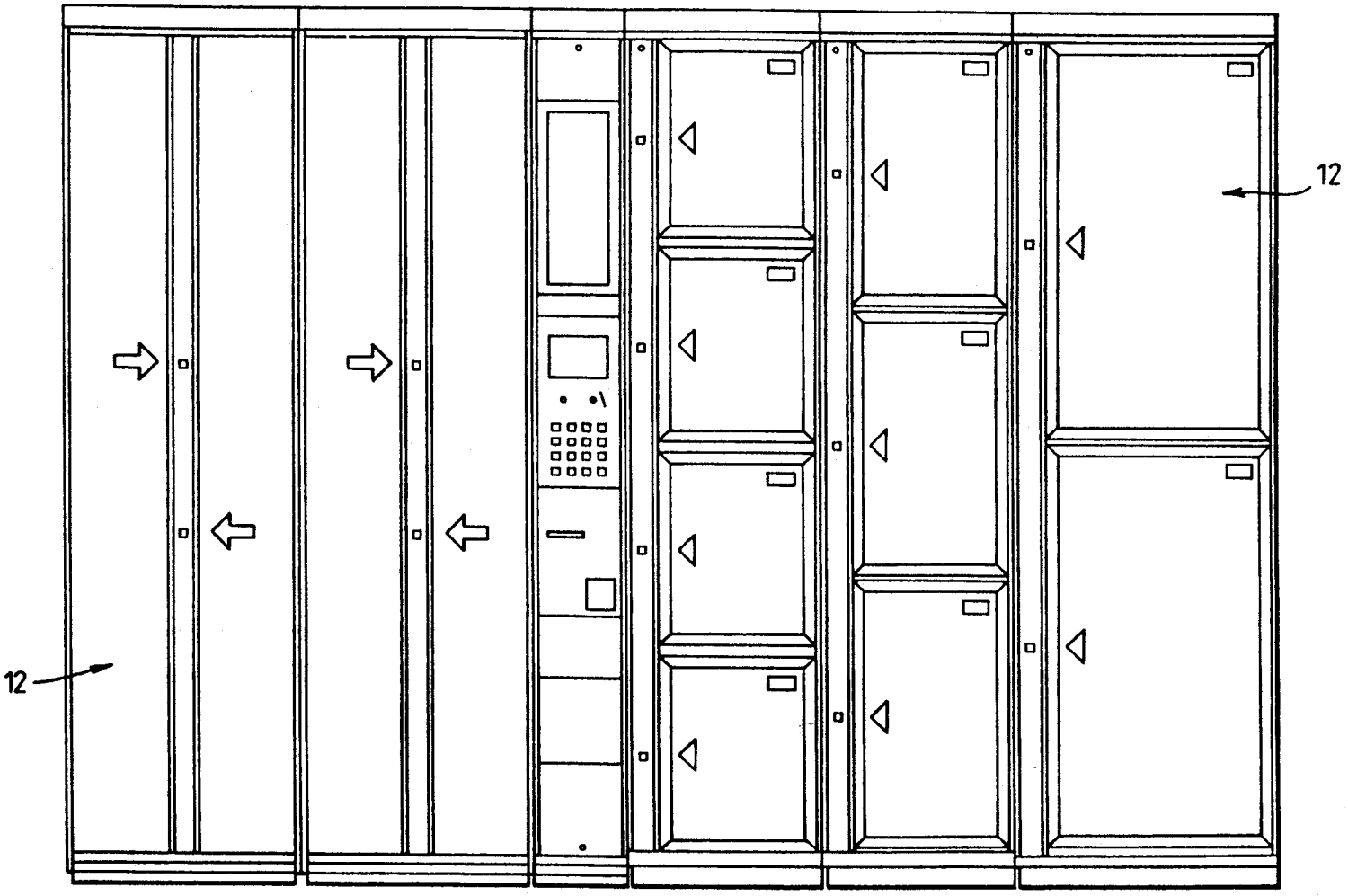
FIG. 3 is a still further alternative arrangement of the storage system according to the present invention.
Figure 4:
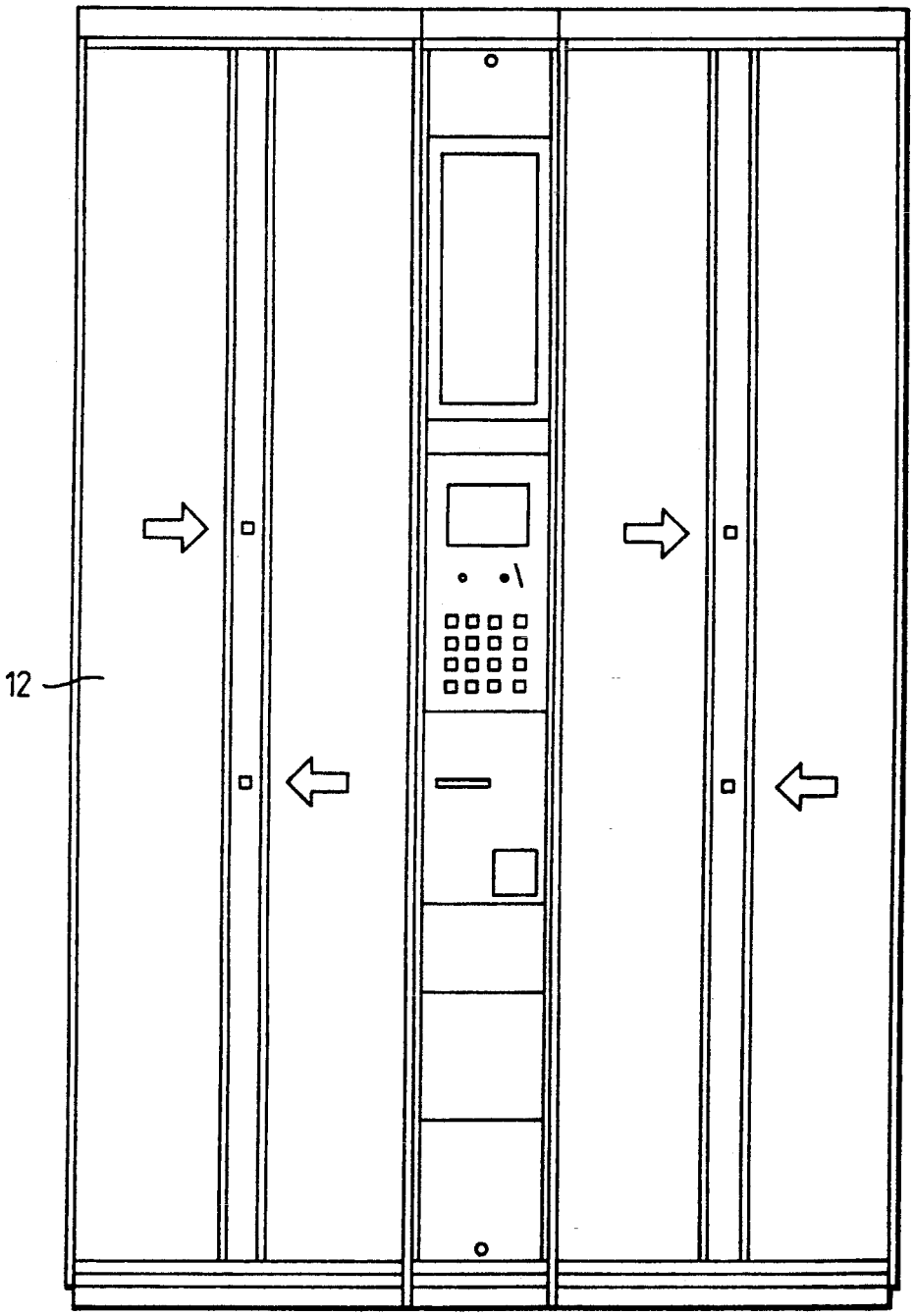
FIG. 4 is a yet another storage system according to the present invention.
Figure 5:
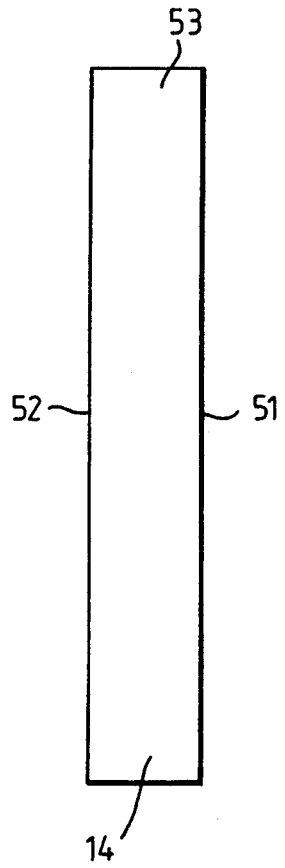
FIG. 5 is a side view of a door according to the present invention.
Figure 6:
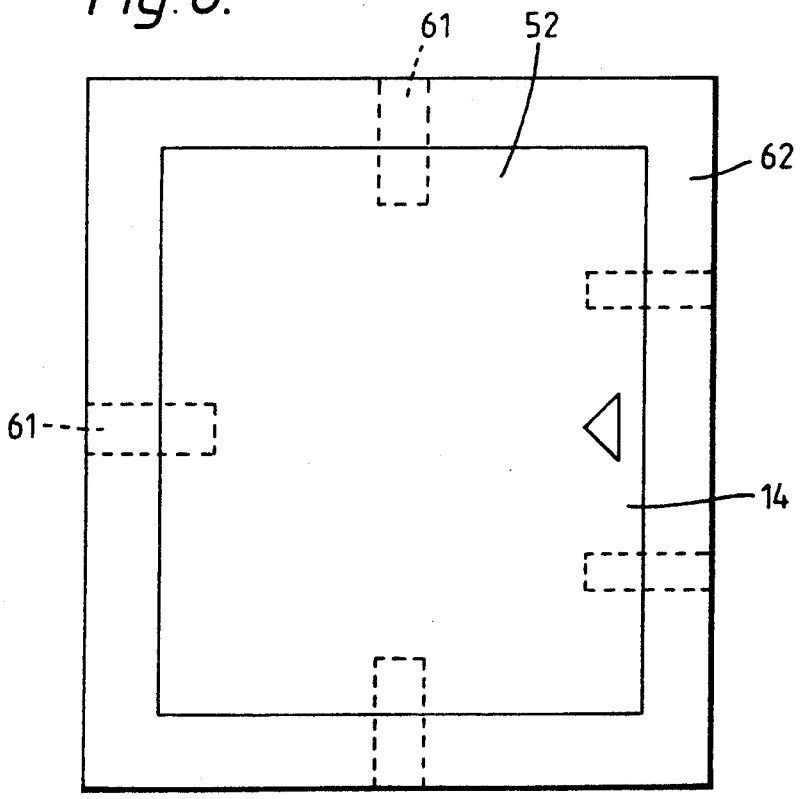
FIG. 6 is a front view of a door set into a storage container according to the present invention.

Embodiments of the present invention will now be illustrated, by way of example only, with reference to FIG. 1 which shows a view of a front elevation of the present invention, FIG. 2 shows a front elevation of an alternative arrangement of the storage system of the present invention, FIG. 3 shows a further alternative arrangement of the storage system of the present invention, FIG. 4 shows yet a further front elevation of the storage system of the present invention, FIG. 5 shows a side view of a door of the present in invention and FIG. 6 shows a front view of a door set into a storage container of the present invention.

Referring now to FIG. 1 this shows a central control unit 1 comprising an instruction panel 2, a screen 3, a slot for entering coins 4, a keyboard 5, a printer for the vouchers 6 and a cash box 7. On either side of the central control unit 1 are columns 8, 9, 10, 11 of storage containers, in this case lockers. It will be apparent that the individual lockers are of differing sizes to accommodate different sized luggage. A typical locker 12 has an indicator 13 showing whether the locker is open or closed. This indicator can be either electronic e.g. a light or mechanical. In addition the lockable access means 14 of each locker, in this case a door, has a flush surface 15 with a door number 16 and a sing 17 on it. The sing 17 is to show which way the door opens.

In use the customer selects an empty locker (shown by the indicator and by the fact that he door 14 is ajar) suitable for his requirements, places the luggage therein and pushes the door 14 too. The door 14 is automatically closed, on being pushed too, by lock means (not shown) in the locker 12. These lock means can include for example electronically activated bolts, catches etc which engage with the door 14 and lock it. Equally the lock means could be on the back of the door 14 and engage with the locker when the door 14 is pushed too.

The customer is then prompted by the screen 3 to pay the appropriate fee. Once the fee has been paid a voucher (not shown) is issued to the customer. Audible and visual alarms are activated at this point to ensure that the customer does not leave without his ticket. If the fee is not paid within a predetermined time then the door will be automatically reopened, To reclaim the luggage the customer must, depending on the type of voucher issued, insert the voucher into an appropriate part not shown) of the central control unit 1 which can then read the coded information on the voucher i.e. the unique identifier number, or alternatively input the unique identifier number on the voucher into the keyboard. Provided that no excess frees are due the door 14 is then opened. If excess fees are due these are shown on the screen and the locker door will then be opened upon payment of the excess fee.

Suitably the voucher issued, when it bears a unique identifier number will be two layered, with the top layer having to be removed to show the identifier number.

Referring now to FIG. 2 this shows an alterative view of a front elevation of a storage system of the present invention wherein the lockers 12 are all of the same size.

Referring now to FIG. 3 this shows a diagrammatic view of a front elevation of a further storage system of the present invention wherein the lockers 12 are different sizes to accommodate different sized articles.

FIG. 4 shows a diagrammatic view of a front elevation of another embodiment of the storage system of the present invention wherein the lockers 12 are adapted to hold skis or similarly large items.

FIG. 5 shows a diagrammatic view of a side elevation of a door 14 of the present invention showing a flush facing outer surface 51 and flush facing inner surface 52 of the door 14. A gap 53 between the flush inner 52 and outer 51 faces can be filled either with air or some other suitable material to deaden explosions including for example foams.

Referring now to FIG. 6 his is a diagrammatic view of a front elevation of a storage container of the present invention showing the outer 51 flush face of a door 14 wherein bolts 61, which are represented by dotted lines, are inserted form the surrounding walls 62 of the storage locker into the door 14 when the door 14 is pushed to and locked. It can be seen that these bolts can, in this particular embodiment, be inserted into the door 14 on all four sides of the door so as to prevent the door being blown outwards should an explosion occur in the locker.

Figure 7:
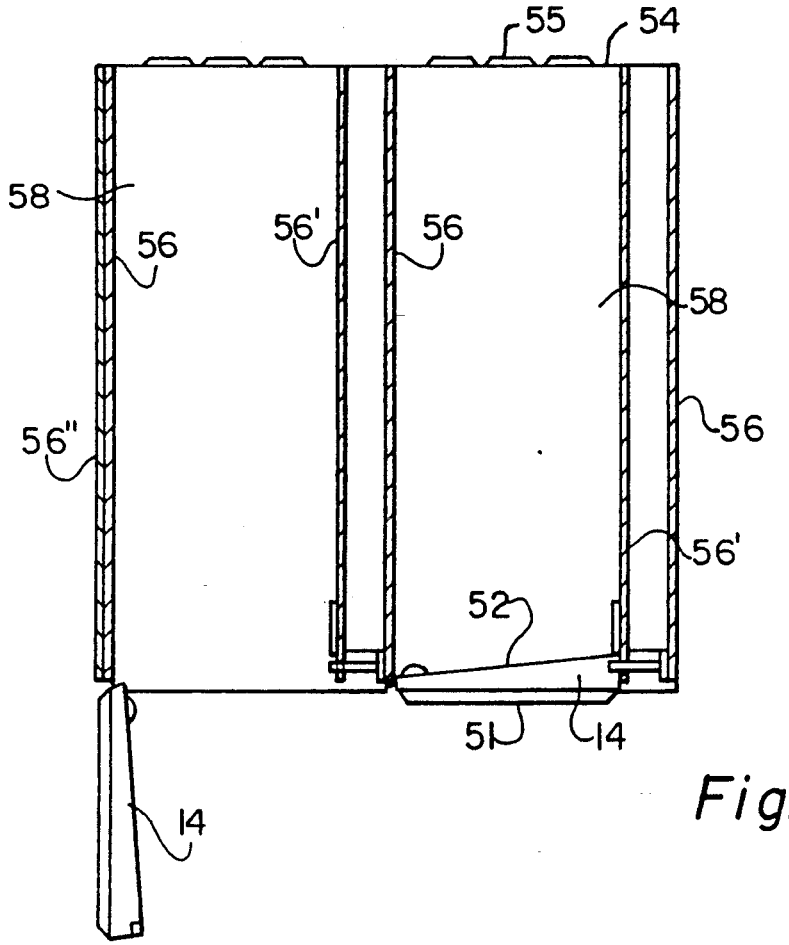
FIG. 7 is a sectional top plan view of two adjacent containers.
Figure 8:
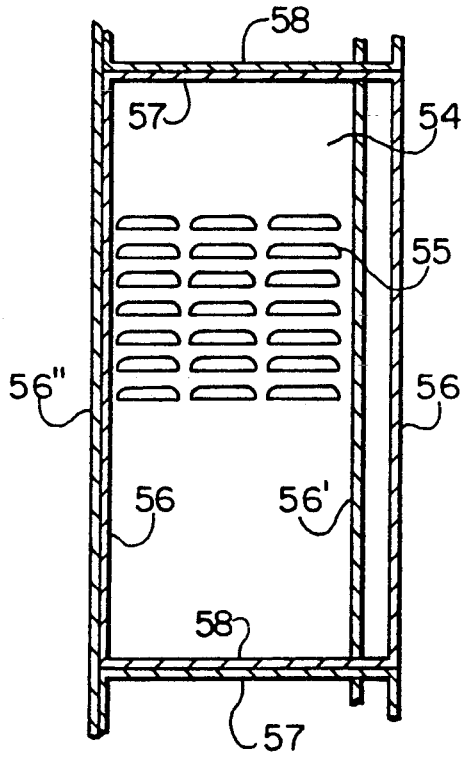
FIG. 8 is a sectional front elevational view of an open container.

As illustrated in FIGS. 7 and 8, the container may also have a thin rear wall 54 which, as mentioned above, includes louvers 55. The rear wall allows force from a blast occurring within the container to move rearwardly, away from door 14. Additionally, the container has side walls 56 and 56', as well as a top wall 57 and a bottom wall 58. As mentioned above, preferably these walls may be doubled skinned with infill inserted between the double skin being either of air or other material suitable to reduce the effects of any explosion.

It is noted that adjacent containers, each having their own individual wall, effectively form a double skinned wall. This double skinned wall thus formed may or may not have a space there between, for containing filler material. Thus, in FIG. 8, the double skins are formed by adjacent side walls 56, 56', and 56, 56'' of adjacent containers. Similarly, double top and bottom walls are formed by subjacent top and bottom walls 57, 58 of subjacent containers.

I claim:

1. A storage system for controlling energy resulting form an explosion occurring herein, the storage system comprising a plurality of containers, at least some of the containers having:

1) a rear, each rear having a louvered rear panel;

2) a front, each front having a lockable access means in the form of a door, the door having:

i) a frontward wall; and ii) means, disposed rearwardly of the frontward wall, for protecting the frontward wall form effects of an explosion within the respective storage container, the means for protecting including means for deflecting the explosion's force substantially rearwardly away from the frontward wall and toward the rear of the container so as to be substantially dissipated through the rear, the means for deflecting being a rearward wall of the means for protecting; and 3) at least one locking mechanism incorporated in at least one corresponding side of the storage container adjacent to the door.

2. The storage system of claim 1, wherein the protecting means includes:

a rearward wall of the door, spaced from the frontward wall of the door; and means for spacing the frontward wall and the rearward wall apart.

3. The storage system of claim 2, wherein the means for spacing includes:

a peripheral side wall of the door constituting means for forming an air space between the frontward and rearward walls.

4. The storage system of claim 3, wherein:

the locking mechanism have at least one bolt; and the peripheral side wall of the door includes at least one recess to receive a respective one of the least one bolt.

5. The storage system of claim 2, wherein the protecting means further includes:

a material within the space between the frontward wall and the rearward wall.

6. The storage system of claim 1, wherein the protecting means includes:

a material disposed immediately behind a rear face of the door's frontward wall.

7. The storage system of claim 1, wherein:

the protecting means includes a planar member spaced from the door's frontward wall.

8. The storage system of claim 7, wherein:

the rear face of the planar member is spaced from the door's frontward wall by a gap between the planar member and the door's frontward wall.

9. The storage system of claim 1, wherein:

each door has no separate lock parts on its front face.

10. The storage system of claim 1, wherein:

each door has no separate lock parts.

11. The storage system of claim 1, wherein:

a) each container includes:

1) a side wall;

2) a top wall; and 3) a bottom wall;

b) at least one of the side wall, top wall and bottom wall is double skinned.

* * * * *